US005420385A

United States Patent [19]

Cooper

[11] Patent Number: 5,420,385

[45] Date of Patent: May 30, 1995

[54] KEY OPERABLE SAFETY SWITCH

[75] Inventor: Alan R. Cooper, Haslingfield, England

[73] Assignee: K.A. Schmersal GmbH, Wuppertal, Germany

[21] Appl. No.: 189,793

[22] Filed: Feb. 1, 1994

[30] Foreign Application Priority Data

Feb. 5, 1993 [DE] Germany ..... 43 03 367.9

[51] Int. Cl.[6] ..... H01H 27/00

[52] U.S. Cl. ..... 200/43.07; 200/43.04; 200/43.08; 200/533; 200/573; 200/302.3

[58] Field of Search ..... 200/43.04, 43.06, 43.07, 200/42.02, 573, 533, 544, 334, 43.08, 302.3; 70/349, 353, 354, 355, 365, 366

[56] References Cited

U.S. PATENT DOCUMENTS 4,395,608 7/1983 Eicker et al. ..... 200/153
4,658,102 4/1987 Seim et al. ..... 200/17
4,963,706 10/1990 Mohtasham ..... 200/334

FOREIGN PATENT DOCUMENTS 3100862 2/1984 Germany .
3302631 8/1984 Germany .
3330109 8/1985 Germany .
3433048 3/1986 Germany .

*Primary Examiner*—Henry J. Recla
*Assistant Examiner*—Peter Hrycko
*Attorney, Agent, or Firm*—Chilton, Alix & Van Kirk

[57] ABSTRACT

A key operable safety switch includes a housing and a switch operator that is operated by an actuator. A slot in the housing receives the actuator. A plurality of discs independently rotatably mounted on an axle, the discs each having a radial recess aligned with the slot and cam-like control grooves, form a roller. The actuator has a coded pattern or actuation portions corresponding to each disc radial recess. Insertion of the actuator engages the actuation portions with the radial recesses causing the discs to be rotated as a whole. A pin mounted to the switch operator and transversely disposed in the control grooves is axially displaced by rotation of the discs. The switch operator is displaced a predetermined stroke to actuate the switch.

19 Claims, 2 Drawing Sheets

KEY OPERABLE SAFETY SWITCH

BACKGROUND OF THE INVENTION

This invention relates generally to key operated protective devices and especially to power control devices which can be employed to prevent the unauthorized use of machinery. More particularly, the present invention relates to key operable safety switches of the type used as safety guard switches.

While not limited thereto in its utility, the present invention is particularly well suited for use as a safety guard switch for electrically powered machinery. Such switches are known in the art as exemplified by the disclosures of German Patent 3,100,862 and published German Patent Applications Nos. 3,330,109, and 3,433,048.

Switches of the type shown in these German Patent and applications generally include an actuating member or key, a housing, a contact, a roller with roller parts and a contact carrier. In operation of this type of prior art safety switch, the actuating member is inserted through an opening in the housing to engage the roller parts and release the roller. Subsequent insertion of the actuating member rotates the roller thereby causing the contact carrier to be displaced, actuating the switch.

Current safety switches suffer from several problems. Typically, the actuating members supplied by the switch manufacturer are all identical to one another. Security is therefore compromised because the switch may be actuated by means of a readily available duplicate actuator. Attempts have been made to solve this problem. For example, an actuating member having a plurality of parts, which must be mounted jointly to perform their function, has been utilized. However, the parts may be mounted on a small board or the like, thereby providing a duplicate key. Another design utilizes an individually electronically coded actuating member in association with a safety switch equipped with an integral reading head and evaluation unit. This design requires larger switches and actuating members and can lead to problems with regard to locating the evaluation unit.

SUMMARY OF THE INVENTION

A key operable safety switch in accordance with the present invention comprises an actuating member or key, a housing accommodating a pair of contacts, a contact carrier, a plurality of discs, and a pin. The contact carrier is composed of a reciprocal plunger or tappet that carries a contact bridge at one end and a transverse pin at the other end. The contact carrier is axially displaced over a predetermined stroke of the tappet to bring the contact bridge into contact with the contacts.

The discs are independently rotatably mounted on an axle. Each disc has a cam-like control groove having two symmetrical cam branches and at least one radial "key" engaging recess. The discs and control grooves are arranged symmetrically to one another so that the discs form a roller. The roller is formed from a combination of discs consisting of a specific number of disc types with differently shaped radial recesses. The radial recesses are aligned in the direction of the axle axis and with a slot-like aperture in the housing. An actuating member or key may be inserted through the aperture to engage the discs at their radial recesses. The actuating member or key has actuating portions whose widths are matched to the width of corresponding disc radial recesses. When the key is pushed in, the radial recesses cooperate with the corresponding actuating portions so that all of the discs are simultaneously rotated in the direction of insertion of the key.

The pin extends transversely through the disc control grooves. Rotation of the discs in either direction causes the pin and tappet to longitudinally move towards the contacts, Sufficient rotation of the discs generates a corresponding stroke of the contact carrier sufficient to cause actuation of the safety switch.

If the key actuating portions do not match the radial recesses of all the corresponding discs, the non-matching discs will not be rotated by insertion of the key. The relative movement between discs will bind the pin within the control grooves, preventing actuation of the safety switch. Such binding will also occur if actuation is attempted by using a simple tool, plate or the like.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DETAILED DESCRIPTION OF PREFERRED EMBODIMENT

Figure 1:
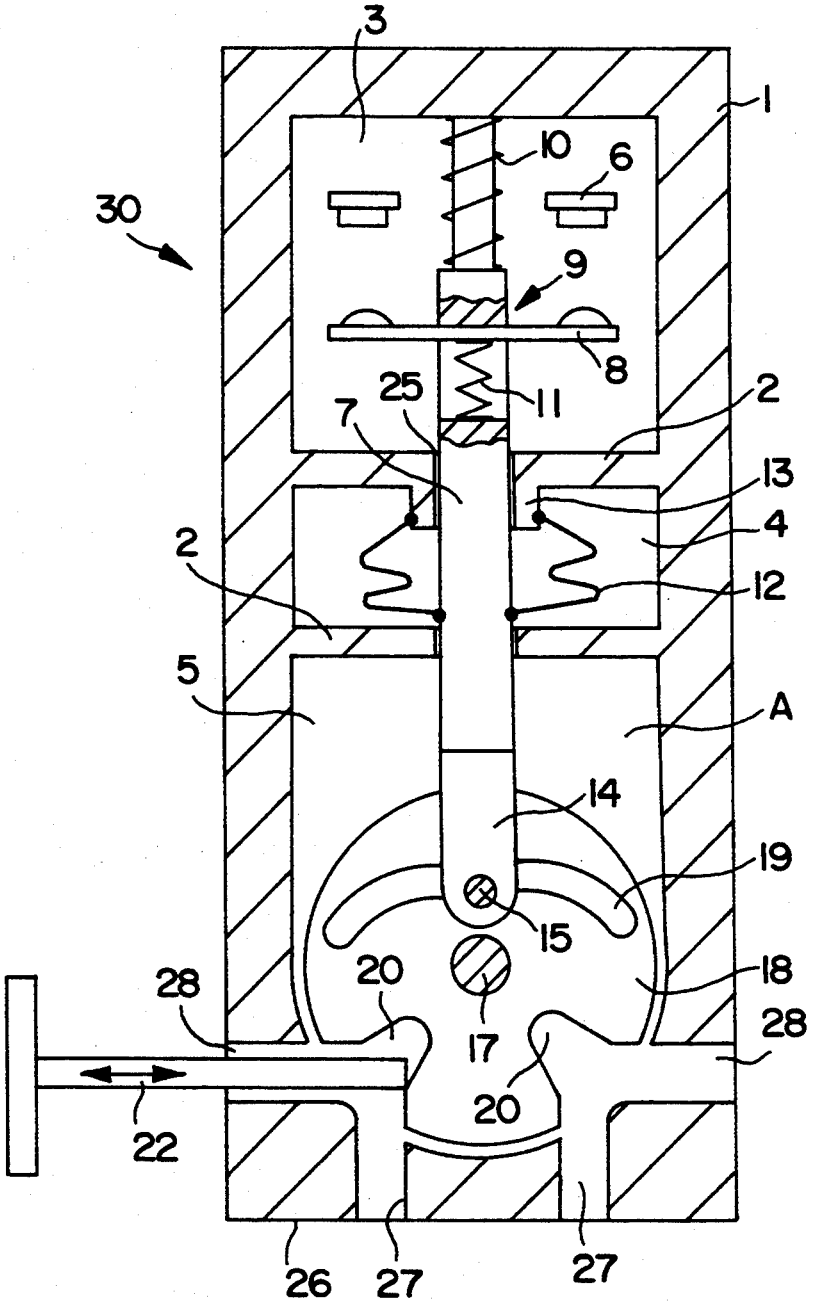
FIG. 1 is a top sectional view of a safety switch in accordance with the present invention.

With reference to the drawings, wherein like numerals represent like parts throughout the several figures, a key operable safety switch in accordance with the present invention is generally designated by the numeral 30. The primary components of switch 30 are a housing 1, a contact carrier 9, a plurality of discs 18 a pin 15, and an actuating member or key 22.

Figure 2:
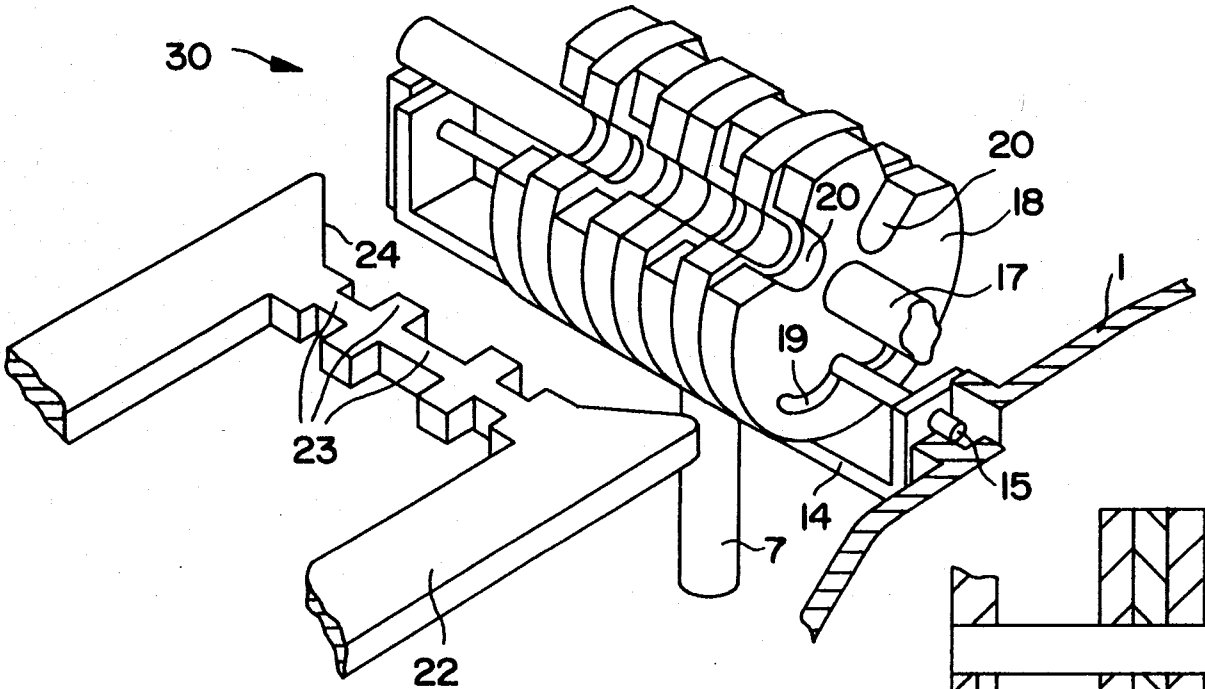
FIG. 2 is an exploded perspective view of the actuator portion A of FIG. 1, FIG. 2 comprising an inverted view when compared to FIG. 1.
Figure 3:
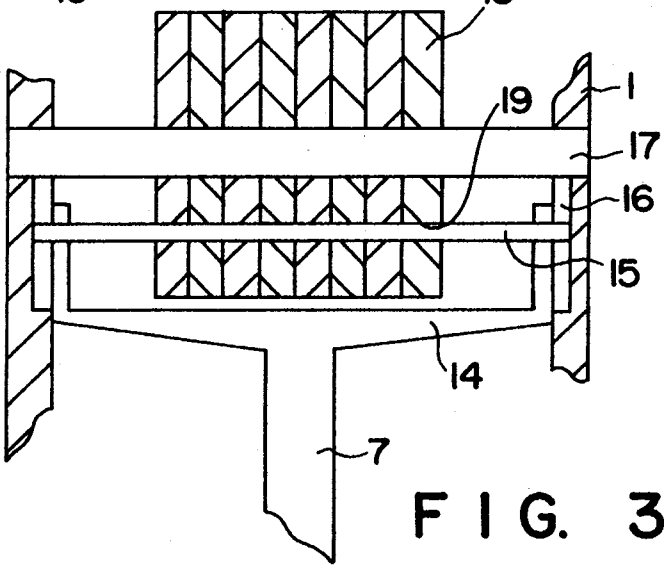
FIG. 3 is longitudinal sectional view through the safety switch of FIG. 2.

Referring to FIGS. 1, 2 and 3, the housing 1 is divided by intermediate walls 2 into a contact chamber 3, a sealing chamber 4, and a roller or actuator chamber 5. A pair of contacts 6 are fixedly mounted within the contact chamber. The contact carrier 9 comprises a tappet 7 which projects into the contact chamber 3 and a contact bridge 8 which is supported on tappet. The tappet 7 is received by bores in the intermediate walls 2 and is biased into an initial position by a first spring 10 which is supported within the contact chamber 3. The contact bridge 8 is axially displaceable, i.e., is movable toward and away from fixed contacts 6, in response to reciprocal motion of the tappet 7. A second spring 11 biases the contact bridge 8 towards the contacts 6. The second spring 11 allows for overtravel of the tappet 7 by providing for relative movement between the contact bridge 8 and the tappet 7.

A sealing bellows 12 extends between the tappet 7 and guide extensions 13 within the sealing chamber 4. The bellows allows axial movement of the tappet 7 while isolating the contact chamber 3 from the sealing chamber 4. This seal prevents moisture from penetrating into the contact chamber 3.

The end of the tappet 7 which projects into the roller chamber 5 carries a stirrup-like mounting 14 for a pin 15. The pin 15 extends transversely relative to the longitudinal axis of the tappet 7. The pin 15 is guided at both ends by a guide groove 16 in the housing (see FIG. 3). The guide groove 16 extends in the direction of the tappet 7 longitudinal axis. The pin 15 and guide groove 16 guide movement of the mounting 14 within the roller chamber 5.

An axle 17 is mounted within the roller chamber 5. The longitudinal axis of the axle 17 is parallel to the longitudinal axis of the pin 15. A plurality of discs 18 are independently rotatably mounted on the axle 17. The discs 18 may be axially displaceable and arranged at a distance from one another on the axle 17 to minimize interaction between discs 18 due to friction.

Each disc 18 has a control groove 19 that receives the pin 15. Each groove 19 resembles a control cam, expediently having two symmetrical cam branches in the form of a very flat "3" or a steep curved "V". Such grooves are shown in greater detail in German Patent Specification 3,100,862 which is incorporated by reference herein. In the initial position, the pin 15 is located at the mid-point of the length of grooves 19. Additionally, each disc 18 has at least one radial recess 20 extending inwardly from the edge thereof. The radial recesses 20 are aligned in the direction of the axis of axle 17 and with slot-like apertures 27, 28 in the housing 1. An actuating member 22 may be inserted through the aperture 21 to engage the discs 18 by their radial recesses 20.

In the embodiment shown in FIG. 1, each disc 18 possesses two radial recesses 20 circumferentially arranged at 90° relative to one another. Additionally, the housing has four actuating apertures 27, 28. Two of the actuating apertures 27 are arranged on the housing end face 26 and the other two actuating apertures 28 are arranged laterally perpendicularly thereto. Each end face actuating apertures 27 is matched with a lateral actuating aperture 28 such that an actuating member 22 introduced in either of the matched actuating apertures 27, 28 meets the same radial recess 20.

The discs 18 and grooves 19 are arranged symmetrically to one another so that the discs form a roller. A sufficient rotation of the discs 18 in either direction generates a corresponding stroke of the contact carrier 9 for actuation of the safety switch. The roller is formed from a combination of discs 18 consisting of a specific number of disc types with differently shaped radial recesses 20. Alternatively, a combination of disc thicknesses may also be utilized. In an alternate embodiment the discs 18 may be divided into two or more groups which are separated from one another by roller portions or intermediate walls.

As may be seen from FIG. 2, the actuating member 22 of the disclosed embodiment has at least one actuating portion 23. The width of the actuating portions 23 are matched to the width of the radial recesses 20, wider radial recesses 20 with correspondingly wide actuating portions 23, narrower ones with correspondingly narrow actuating portions 23. If the discs 18 are axially displaceably and arranged at a distance from each other, it is expedient to provide laterally projecting wedge faces 24 on the actuating member. The wedge faces 24 will displace the discs into position so that the actuating portions 23 subsequently engage the corresponding radial recesses 20. As a result the lateral tolerance for the introduction of the actuating member 22 can be increased considerably.

When the actuating member 22 is pushed in, the radial recesses 20 cooperate with corresponding actuating portions 23 so that the discs 18 as a whole are rotated according to the direction of insertion of the actuating member 22. Rotation of the discs 18, as a result of cooperation between pin 15 and the control grooves 19, causes axial displacement of the pin 15 and tappet 7. The contact carrier 9 is thereby displaced, actuating the safety switch.

If the actuating portions 23 of actuating member 22 do not match the radial recesses 20 of all of the corresponding discs 18, the non-matching discs 18 will not be rotated by insertion of the actuating member 22. The resulting relative movement between discs 18 will bind the pin within the control grooves 19, preventing actuation of the safety switch. Such binding will also occur if actuation is attempted by using a simple tool, plate or the like.

The safety switch 30 can be actuated only by means of a highly specific actuating member 22. If six discs 18 selected from five different disc shapes are used, 15625 ($5^6$) different possible combinations are obtained. The use of additional discs or additional disc shapes provide correspondingly large increases in possible combinations. Therefore, misuse by a duplicate actuating member can be effectively prevented. The size of the safety switch 30 as well as the outlay in terms of construction and assembly are virtually unaffected by this type of coding.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. In a safety switch device, said switch device having a housing which defines a chamber and at least one slot via which communication may be established between the exterior of the housing and the chamber, at least a pair of electrical switch contacts being provided within the chamber, at least one of the contacts being supported from the housing and at least one other of the contacts being mounted on a moveable contact support disposed within the chamber, the moveable contact support being engaged by an operating means within the housing whereby the contact support is displaceable along a path over a predetermined stroke to cause the one contact to engage or disengage the other contact, the improvement comprising:

said contact support having a first end, said contact support including a pin mounted to said first end;

operating means for imparting motion to said contact support, said operating means comprising a plurality of codeable disc means disposed within said housing chamber, said operating means including an axle, said axle having an axis orientated substantially parallel to said pin, said disc means being independently rotatably mounted on said axle, said disc means each having a cam-like control groove, said control grooves being in alignment, said pin being received in said aligned control grooves whereby simultaneous rotation of said disc means will cause said contact support to be displaced over said stroke, said pin preventing said disc means from rotating individually about said axle by an amount sufficient to produce movement of said pin to cause said contact support to be displaced over said stroke, said disc means each further having at least one radial recess facing said housing slot; and an actuating member insertable into the housing slot, said actuating member having a coded pattern of actuating portions shaped and positioned to engage a wall portion of said disc means radial recesses whereby said disc means may be simultaneously rotated as a roller to cause displacement of said contact support over said stroke.

2. The device of claim 1 wherein said discs are arranged axially displaceable on said axis and said actuating member has two wedge faces for displacement of said discs.

3. The device of claim 1 wherein the housing comprises a pair of grooves and wherein said pin is guided in the housing in the direction of movement of said contact support.

4. The device of claim 1 wherein said contact support first end defines a stirrup-like mount for said pin.

5. The device of claim 1 wherein a said radial recess for one of said discs may have a different shape than a said radial recess of another of said discs wherein all of said discs having the same shape radial recess define a disc type.

6. The device of claim 5 wherein said operating means is formed from a combination of said discs and wherein each of said discs is selected from a disc type.

7. The device of claim 5 wherein one of said discs may have a different thickness than another of said discs wherein all of said discs having the same shape radial recess and the same thickness define a disc type.

8. The device of claim 7 wherein said operating means is formed from a combination of said discs and wherein each of said discs is selected from a disc type.

9. The device of claim 1 wherein said cam-like control grooves are arranged symmetrically to one another, each of said control grooves having two cam branches wherein said cam branches generate a stroke of said contact support.

10. The device of claim 1 wherein each of said radial recesses has a wide entry region wherein said actuating member may engage said radial recesses through either a first of said slots or a second of said slots, said second slot being at right angles to said first slot.

11. The device of claim 1 further comprising spring means disposed in the housing and engaging said contact support, said spring means biasing said contact support to a first position wherein the safety switch device is not actuated.

12. A safety switch device comprising:

a housing having at least an end face and first and second sides, said housing having at least an end face and first and second sides, said housing defining first, second, third and fourth slots wherein said first and second slots are disposed in said end face, said third slot is disposed in said first side and said fourth slot is disposed in said second side;

at least a first stationary switch contact disposed within said housing;

a moveable contact support disposed within said housing, said contact support having opposite first and second ends, said contact support first end defining a receiver, a drive pin being received in said receiver, at least a second switch contact being mounted on said contact support for movement therewith, said contact support being displaceable via said pin over a predetermined stroke to actuate said safety switch device by causing relative movement between said first and second contacts;

spring means disposed in said housing and engaging said contact support, said spring means biasing said contact support to a first position wherein said switch contacts are in a first state;

rotatable operating means comprising a plurality of codeable disc means disposed within said housing, said disc means being independently rotatably mounted on an axle, said axle having axis that is substantially parallel to said drive pin of said contact support, said disc means each having a cam-like control groove, said control grooves receiving said drive pin of said contact support, said disc means each further having a first and a second radial recess, said first radial recess facing said first and third slots, said second radial recess facing said second and fourth slots, said operating means being normally blocked against rotation; and an actuating member insertable through said slots, said actuating member having a coded pattern of actuating portions for engaging predetermined portions of said disc means radial recesses whereby said disc means may be simultaneously rotated each of said radial recesses having a wide entry region wherein said actuating member may engage said first radial recess through either said first or third slots or said second radial recess through either said second or fourth slots.

13. The device of claim 12 wherein said discs are arranged axially displaceable on said axis and said actuating member has two wedge faces for displacement of said discs.

14. The device of claim 12 wherein said housing comprises a pair of groves wherein said drive pin is guided in said housing in the direction of movement of said contact support.

15. The device of claim 12 wherein said radial recesses for one of said discs may have a different shape than said radial recesses of another of said discs wherein all of said discs having the same shape radial recesses define a disc type.

16. The device of claim 15 wherein said operating means is formed from a combination of said discs are wherein each of said discs is selected from a disc type.

17. The device of claim 12 wherein said cam-like control grooves are arranged symmetrically to one another, each of said control grooves having two cam branches wherein said cam branches generate a stroke of said contact support.

18. The device of claim 12 wherein said housing further comprises first and second interior intermediate walls defining a contact chamber, a sealing chamber and an operating means chamber, said contact support second end and said spring means being disposed in said contact chamber and said contact support first end and said operating means being disposed in said operating means chamber.

19. The device of claim 18 further comprising seal means for sealing said contact chamber, said seal means being disposed in said sealing chamber.

* * * * *